US005722612A

United States Patent [19]

Feathers

[11] Patent Number: 5,722,612

[45] Date of Patent: Mar. 3, 1998

[54] CLUTCH MECHANISM FOR USE IN SAFETY APPARATUS

[75] Inventor: Leonard John Feathers, Corwen, United Kingdom

[73] Assignee: Barrow Hepburn Sala Ltd., United Kingdom

[21] Appl. No.: 663,284

[22] PCT Filed: Jan. 13, 1995

[86] PCT No.: PCT/GB95/00068

§ 371 Date: Sep. 9, 1996

§ 102(e) Date: Sep. 9, 1996

[87] PCT Pub. No.: WO95/19204

PCT Pub. Date: Jul. 20, 1995

[30] Foreign Application Priority Data

Jan. 18, 1994 [GB] United Kingdom ..... 9400895
Aug. 18, 1994 [GB] United Kingdom ..... 9416720

[51] Int. Cl.[6] ..... A62B 35/04

[52] U.S. Cl. ..... 242/381.5; 192/7; 192/103 C

[58] Field of Search ..... 192/7, 8 A, 12 R, 192/103 C; 242/381.5, 383.2, 383.5; 254/267, 375; 182/237, 239

[56] References Cited

U.S. PATENT DOCUMENTS 2,990,131 6/1961 Carlsson ..... 242/381.5 X
4,846,313 7/1989 Sharp ..... 242/381.5 X
5,351,906 10/1994 Feathers ..... 242/381.5 X
5,447,280 9/1995 Feathers ..... 242/381.5

FOREIGN PATENT DOCUMENTS 9308788 8/1993 Germany .
1552667 9/1979 United Kingdom .
WO A
9111217 8/1991 WIPO .

*Primary Examiner*—Richard M. Lorence
*Attorney, Agent, or Firm*—Nixon & Vanderhye P.C.

[57] ABSTRACT

A speed-sensitive clutch device incorporates at least one drive-transmitting coupling element (17) which is connected to a safety line drum (1) so that it bodily rotates with the drum (1) about its axis of rotation and is displaceable from an inactive position (FIG. 1) into a drive-transmitting position (FIG. 2) in which it transmits drive. And the speed-sensitive clutch device also incorporates an inertia member (20) which is freely rotatable about the axis of drum rotation and yet is free to move in rotation relative to the drum itself. The inertia member (20) is formed and disposed so that on rapid acceleration of the drum (1) it exerts pressure, due to its inertia, against a said coupling element (17) thereby to cause or assist movement of the coupling element from its inactive position into its drive-transmitting position.

7 Claims, 7 Drawing Sheets

CLUTCH MECHANISM FOR USE IN SAFETY APPARATUS

This invention relates to safety apparatus for use by persons working at height. Such apparatus is of the kind which is attachable to a fixture and incorporates a safety line drum holding a safety line for attachment to a worker's safety harness. The safety line can be drawn from the drum in response to pulling force on the line exerted by the user in the course of his work but the apparatus has arresting means which functions automatically if the unwinding speed of the drum becomes excessive as it does in the event of the worker falling.

The arresting means functions to decelerate the drum, usually to rest. Thus, the clutch mechanism may operate to stop drum rotation almost immediately, in the event of acceleration reaching a predetermined speed such as occurs in the event of a fall. Or, the line drum may be permitted to continue to rotate so that the safety line may continue to pay out, but at a limited, controlled speed.

Conventionally, the arresting means incorporates a centrifugal clutch device designed so that centrifugal force is relied upon for causing drive-transmitting coupling elements of the clutch to move into driving engagement with a fixed abutment to stop drum rotation; or, the drive-transmitting coupling elements of the clutch are moved into driving engagement with a rotatable component of a braking device, the consequential rotation of this brake component being opposed by friction which brings about the deceleration of the drum.

The conventional centrifugal clutch means hereinbefore referred to has been found to be unsuitable for reliably achieving the rotational speed-sensitivity which some use situations require. In particular, for certain work situations in which workers are working at a very modest height above the ground, a worker who falls may hit the ground before the clutch brings into play means capable to retarding or arresting the fall, or at least before the descent speed has been reduced sufficiently to prevent serious injury to the worker on such impact. In other words, too much time elapses between the commencement of rapid acceleration of the drum and engagement of the centrifugal clutch. Attempts to design the clutch so that the centrifuging elements are actuatable by centrifugal forces of smaller magnitude have resulted in the clutch being too sensitive in the sense that it is liable to be engaged by accelerations of the drum such as may result from ordinary movements of the worker. This could create an additional accident hazard.

The performance of the fall-arrest or fall retard mechanism is critically dependent on the sensitivity of the device clutch to the speed of drum rotation and the reliability and efficiency of its operation. The present invention has emerged in the course of research carried out with a view to achieving reliability standards and speed-sensitivity characteristics which are not attainable by apparatus incorporating a conventional form of centrifugal clutch.

Broadly stated, fall-arrest or fall-retard apparatus according to the present invention is characterised in that the speed-sensitive clutch for coupling the safety line drum to another component, thereby to effect retardation of the drum, incorporates (i) at least one drive-transmitting coupling element which is connected to the safety line drum so that it bodily rotates with the drum, about the axis of rotation of the drum, and is displaceable from an inactive position into a drive-transmitting position in which it transmits drive to said other component and (ii) an inertia member which is freely rotatable about said axis and relative to the drum itself; and in that said inertia member is formed and disposed so that in a normal operation it rotates together with the coupling element, while on the occurrence of rapid acceleration of the drum in consequence of a fall, the inertia member exerts pressure, due to its inertia, against said coupling element in such occurrances to cause or assist movement of the coupling member into its drive-transmitting position.

The invention enables a fall to be arrested in a shorter time. In other words, the invention enables a fall-arrest apparatus to have a shorter response time (meaning a shorter time between the commencement of a rapid acceleration of the safety line drum and the engagement of the clutch) than apparatus incorporating a conventional centrifugal clutch. And this result can be achieved without compromising the standard of safety in terms of the maximum fall-arrest force sustained by the falling body, which latter is determined by the shock-absorbing means which is necessarily present in or associated with the apparatus.

And the shortening of the response time does not necessitate making the clutch too speed-sensitive and therefore liable to cause spurious actuation of any braking means provided for the drum during normal movements of the worker attached to the safety line. The shorter response time results in fall-arrest forces being lower and this affords the derivative benefit that the forces imposed on the clutch are reduced and lighter gauge materials can be used. The response time depends on the inertia of mass of the inertia member and any frictional resistance to its rotary movement about the axis of the drum. The latter factor can be and is preferably so small as to be negligible. In designing a given apparatus it is a simple matter to select the mass of the inertia member to achieve a given response time.

It is normally very desirable for the clutch to incorporate more than one drive-transmitting coupling element and in the following further description of the invention the presence of at least two such elements will be assumed.

It is likewise preferable for there to be only one inertia member and for convenience reference is hereafter made to "the inertia member". It is to be understood however that the use of more than one such member is not excluded from the scope of the invention. For example, if there are two or more drive-transmitting coupling elements there may be separate inertia members for cooperating with the different coupling elements.

In certain embodiments of the present invention, the coupling elements of the clutch are arranged so that they are movable into operative position under the action of centrifugal forces. For example the elements can be in the form of pivoted pawls as used in the centrifugal clutches of conventional fall-arrest apparatus as hereinbefore referred to. In such cases, the movement of the elements into operative position takes place under the combined action of centrifugal force and the force exerted against such elements by the inertia member. As in conventional centrifugal clutches used in fall-arrest apparatus of the kind with which this invention is concerned, spring means can be employed for holding the elements in their inoperative positions during normal rotations of the safety line drum. The movement of the coupling elements into their operative positions takes place against the resistance of such spring means.

The invention is particularly although not exclusively intended for ensuring rapid actuation of a mechanism for braking the line drum within a relatively short time; in other words for providing apparatus which can be used by workers when working not very far above the ground. Accordingly, in preferred embodiments of the invention the inertia of the inertia member is such that on rapid acceleration of the drum such as occurs in consequence of a fall of a worker attached to the safety line, the drive-transmitting coupling elements of the clutch move into operative position sooner than if reliance were placed on movement of such elements solely under centrifugal force.

Another problem associated with the conventional clutch means hereinbefore used is that of ensuring simultaneous engagement of a number of centrifuging drive-transmitting coupling elements of the clutch. One reason for this is that at any given time gravity has unequal effects on the movements of the different pawls. If the coupling elements do not simultaneously enter into driving engagement the clutch is subjected to driving torque eccentrically. The torque may be transmitted initially or even entirely via only one of the elements. The eccentric forces imposed on the mechanism are liable to cause substantial damage to the mechanism. With a view to alleviating this problem it has been proposed to increase the number of centrifuging elements but this expedient involves size and weight penalties on the mechanism.

Preferably the coupling elements of the clutch of apparatus according to the present invention are arranged so that in their inoperative positions they are both in contact with or very close to a common inertia member and this member always moves the elements simultaneously and to the same extent.

As described above, where braking means are provided, these will normally be constituted by braking means which are constituted and arranged so that when they are brought into operation, the drum carrying the safety line is first decelerated, and then brought to rest. And the invention is applicable to apparatus incorporating such types of braking means. However those skilled in the art will readily understand and appreciate that the invention is equally applicable, and indeed advantageous, when incorporated in apparatus in which the braking means first decelerates the drum, and then, instead of stopping drum rotation completely, allows rotation of the drum to continue, but at a controlled speed which is sufficiently slow as to prevent or inhibit the occurrance of serious injury to a worker who is suspended on the safety line. For example this will permit controlled lowering of the worker towards the ground or towards a platform.

This invention also extends to fall arrest apparatus comprising a line drum supported by a shaft for rotation relative to a rigid plate member adapted to be secured to a fixed anchorage, a safety line wound on the drum and which can be paid out with the drum unwinding against the influence of a rewind coil spring, there being, operable between said plate member and said drum, unwind rotational speed sensitive clutch means incorporating an inertia member of the type as above defined, operation of said clutch means as assisted by said inertia member, being effective substantially immediately, to stop rotation of the drum relative to the rigid plate member when a predetermined speed of drum rotation is exceeded.

In such an arrangement where no breaking means are provided, the said safety line incorporates at or towards its outboard end, an energy dissipating unit for cushioning shock loads occasioned in the safety line, said energy dissipating unit being so connected in the safety line that it can only be disconnected by such destructive breaking of the connection as to render the connection non-reusable.

The invention will now be described by way of example with reference to the accompanying drawings in which:

In FIG. 1 the drive-transmitting coupling elements are shown in the disengaged condition while in FIG. 2 they are shown in the engaged condition;

Figure 1:
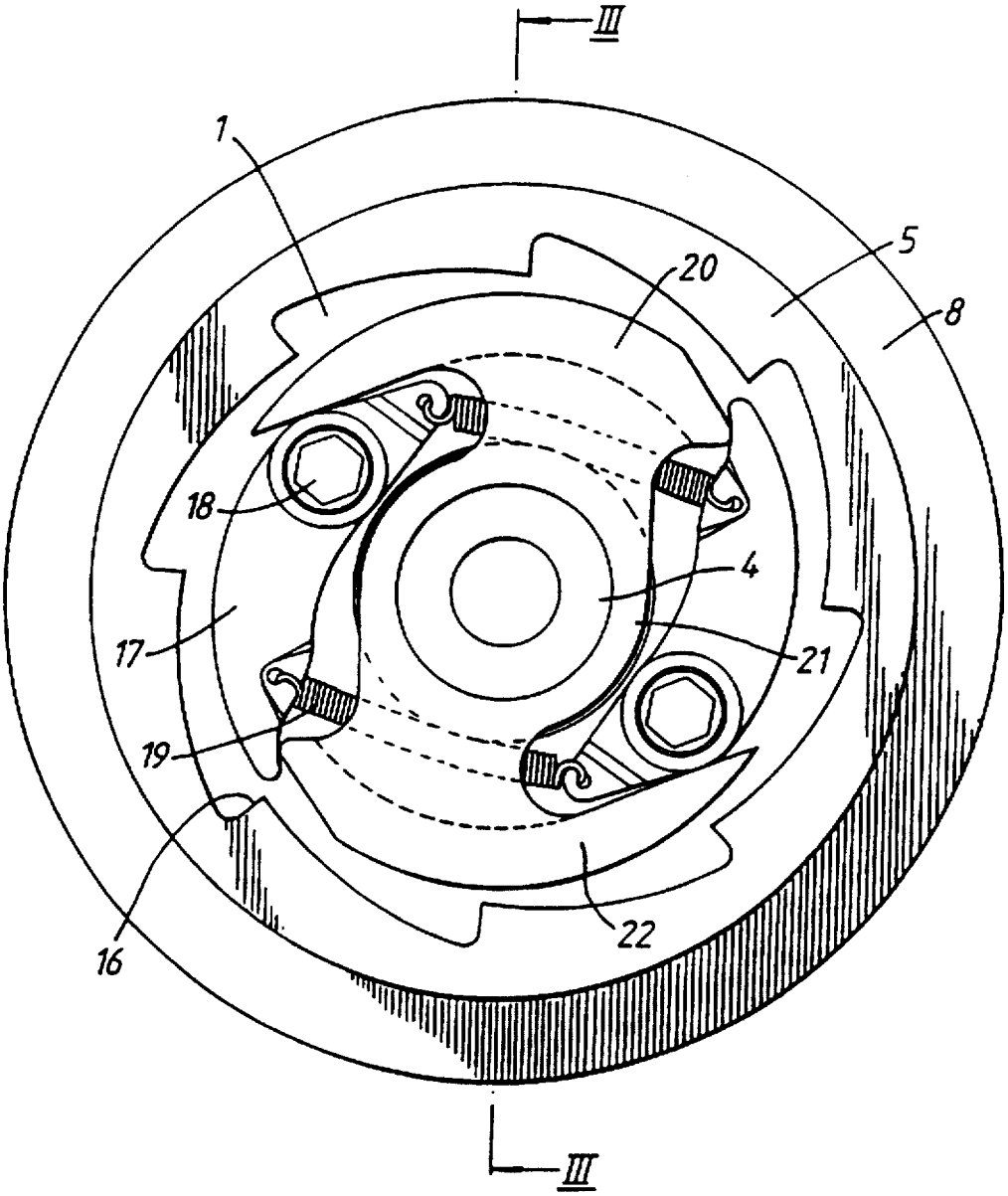
FIGS. 1 and 2 are frontal views illustrating a centrifugal clutch mechanism according to this invention.

The apparatus illustrated in FIGS. 1 to 4 includes drum braking means. The apparatus comprises a cable drum 1 which is rotatable on a shaft 2. A cable 3 is wound onto the drum. The drum hub is mounted on a bearing bush 4 surrounding the shaft. An aligned bearing bush 41 also on the shaft serves as the inner bearing of a rotatable brake disc 5. Brake disc 5 has at one side thereof an axially protruding annular rib 6 which intrudes into an aperture in a plate 7. The rib 6 has a smooth exterior peripheral surface and makes a close sliding fit in the said aperture so that the plate 7 serves as an outer bearing for the brake disc. The plate 7 constitutes a load-bearing spine which carries the drum and drum brake assembly. The upper portion of the plate 7 is formed with an aperture 7A and serves as a handle by which the apparatus can be suspended from a fixture.

A peripheral margin of the brake disc 5 forms a radial flange 8 which overlaps a marginal portion of the plate 7 surrounding its said aperture. Brake rings 9, 10 are located against the opposite faces of the flange 8 and these rings and the flange are held firmly together and against the spine plate 7 by a clamping ring 11 which is secured to the spine plate by bolts 12.

The major part of the spine plate 7 assembly which it card brake assembly which it carries are enclosed in a casing 13. One part of this casing carries a centering bearing 14 for one end of the shaft 2.

In use, the cable 3 is attached to a worker's safety harness. Pull forces exerted on the cable due to normal movements of the worker cause the drum to rotate so that the necessary further length of cable is released and it does not restrain such movements. Such unwinding motion of the drum takes place against the action of a spiral spring 15 which is housed in a recess in the drum and is connected at one end to the drum and at the other end to the shaft 2. The spring serves automatically to rotate the drum in the winding direction when winding in of the cable is not restrained by the worker. Consequently, when the worker moves nearer the place where the apparatus is secured to the fixture, the slack which would otherwise appear in the cable is automatically taken up.

Figure 5A:
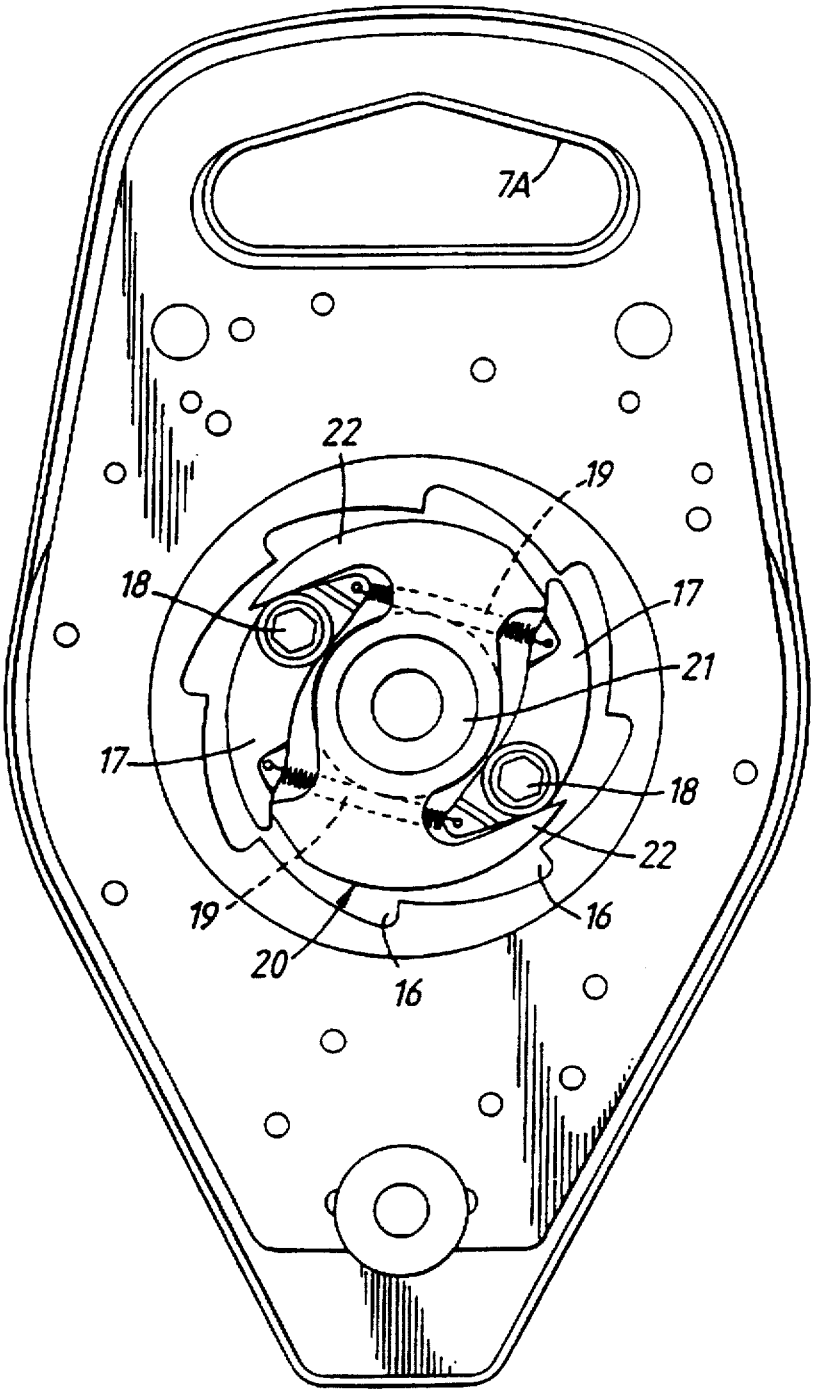
FIGS. 5A and 5B are front elevations of the apparatus of FIG. 4 with parts removed to reveal component parts of the clutch.
Figure 5B:
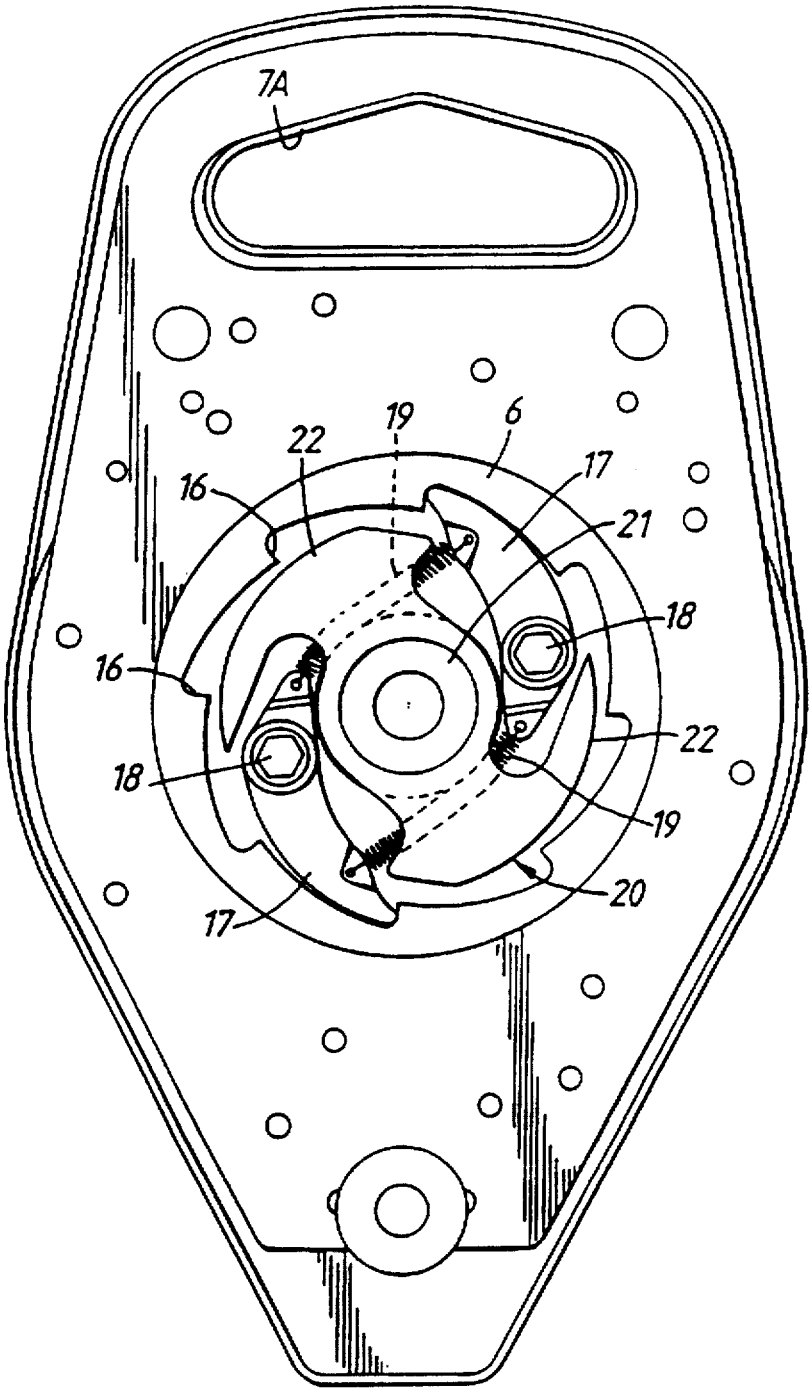

Around the inside of the rib 6 on the brake disc 5 there is a series of abutments 16 (FIGS. 5A and 5B) which are in the form of raked teeth. The cable drum carries coupling elements 17 which are in the form of pawls for engaging those teeth. The pawls are pivotally mounted on pins 18 which are screwed into the drum 1. The pawls 17 are eccentrically mounted on the pins 18 so that when the drum is rotating in the unwinding direction centrifugal force tends to cause pivotal movements of the pawls 17 such that their longer arms swing outwardly towards the surrounding series of teeth 16. The pawls 17 are biased against such pivotal movements by springs 19 so that they retain their inoperative positions during slow unwinding movements of the drum such as occur during normal pay-out of the cable. If the pawls 17 undergo sufficient pivotal movement to bring them into engagement with teeth 16 on the brake disc 5, this disc is forced to rotate against the frictional resistance imposed by the brake assembly comprising the spine plate 7, the brake disc 5, the clamping ring 11 and the sandwiched brake rings 9,10. The frictional braking forces decelerate the drum and arrest or retard the fall.

As so far described the fall-arrest apparatus of this kind is as previously known. The centrifugal forces imposed on the clutch coupling elements 17 in the event of a fall are relied upon to displace them into their operative driving engagement with the rotatable brake disc 5. The apparatus illustrated in FIGS. 1, 2 and 3 differs from such known apparatus in that it incorporates an inertia member 20 which has an activating action on the clutch coupling elements 17.

Figure 2:
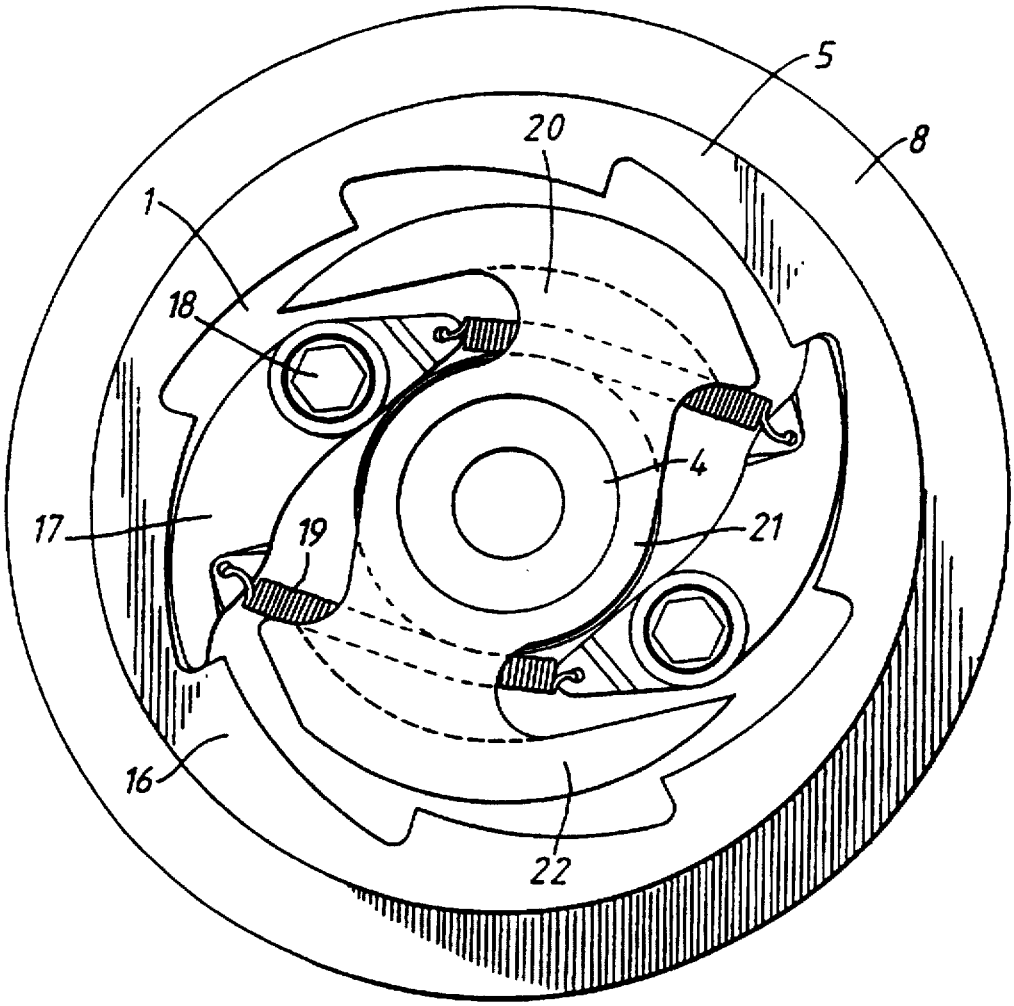
Figure 3:
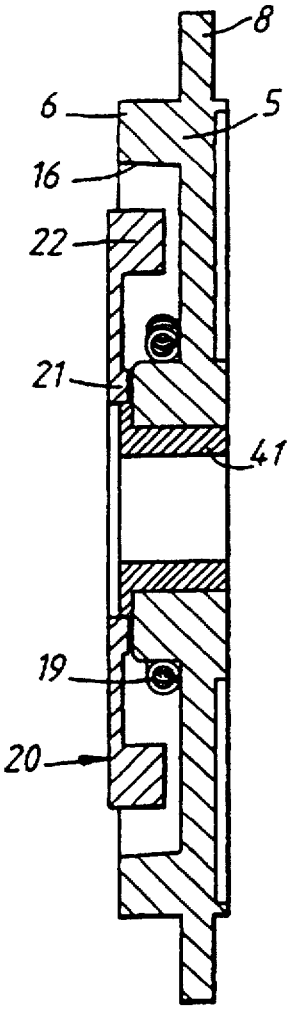
FIG. 3 is a cross-sectional view taken on the line III—III of FIG. 1.
Figure 4:
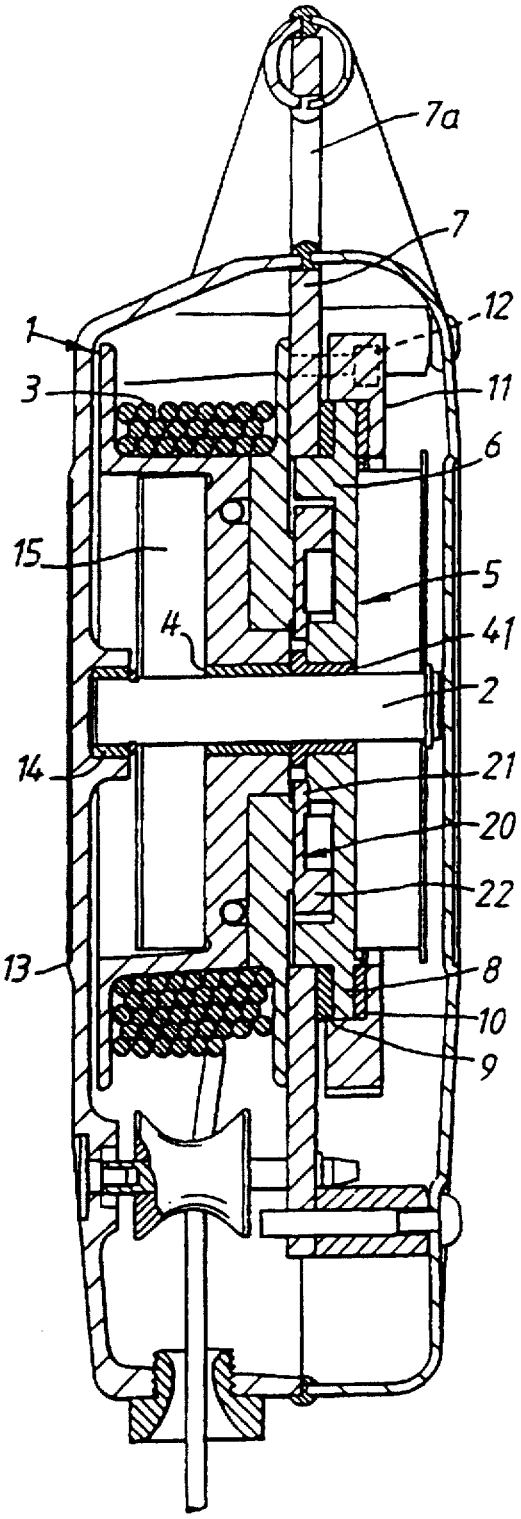
FIG. 4 is a side sectional elevation of one example of a fall arrest or fall retard assembly which incorporates a clutch mechanism according to this invention.

The inertia member 20 is a metal component coated with PTFE. It is freely rotatable around the drum shaft 2, between and relative to the drum 1 and the brake disc 5. The inertia member comprises a hub portion 21 which runs on the bearing bush 4 and radial neck portions which join the hub portion with diametrically opposed thickened rim portions 22. FIG. 1 shows the clutch components in the positions which they normally occupy during use of the apparatus. The pawls 17 are in their inoperative positions and rotate bodily with the drum 1, out of engagement with the teeth 16 of the brake disc 5. Because the inertia member 20 is not positively connected to the drum 1, on rotation of the drum 1 it tends, due to its inertia, to retain its angular orientation around the shaft 2. However the pawls 17 held in by the springs 19 abut against the thickened rim portions 22 of the inertia plate and cause it to accompany their rotation around the shaft. The inertia of the member 20 is such that if the drum is rapidly accelerated due to a fall, the reaction force to which the pawls 17 are subjected in overcoming the inertia of the inertia member, significantly assists movement of the pawls 17 into engagement with the teeth 16 of the brake disc 5. The pawls are displaced into engagement with teeth 16 under the combined influence of that reaction force and centrifugal force and the clutch is engaged sooner than it would be if reliance were placed solely on the centrifugal force. FIG. 2 shows the parts of the clutch in the positions which they occupy immediately after engagement of the drive transmitting components of the clutch.

The longer arm of each of the pawls 17 abuts against one end (abutment end) of the adjacent thickened rim portion 22 of the inertia member 20. The abutment ends of the opposed thickened rim portions 22 are accurately diametrically opposed with respect to the axis of the inertia member 20. Consequently the abutment forces which are exerted on the two pawls 17 due to the inertia of the inertia member 20 always act on the two pawls simultaneously and in balanced manner.

The thickened rim portions 22 of the inertia members are of such size and shape that when the pawls 17 are in their normal inoperative positions (FIG. 1) each of those rim portions 22 is in contact with or very nearly in contact with both of the pawls 17. Consequently there is no or virtually no angular play between the inertia member 20 and the pawls 17. If the cable drum 1 is rapidly accelerated, activating forces exerted on the pawls 17 due to the inertia of the inertia member 20 are therefore exerted instantanously at the commencement of any rapid acceleration of the cable drum 1.

Figure 6A:
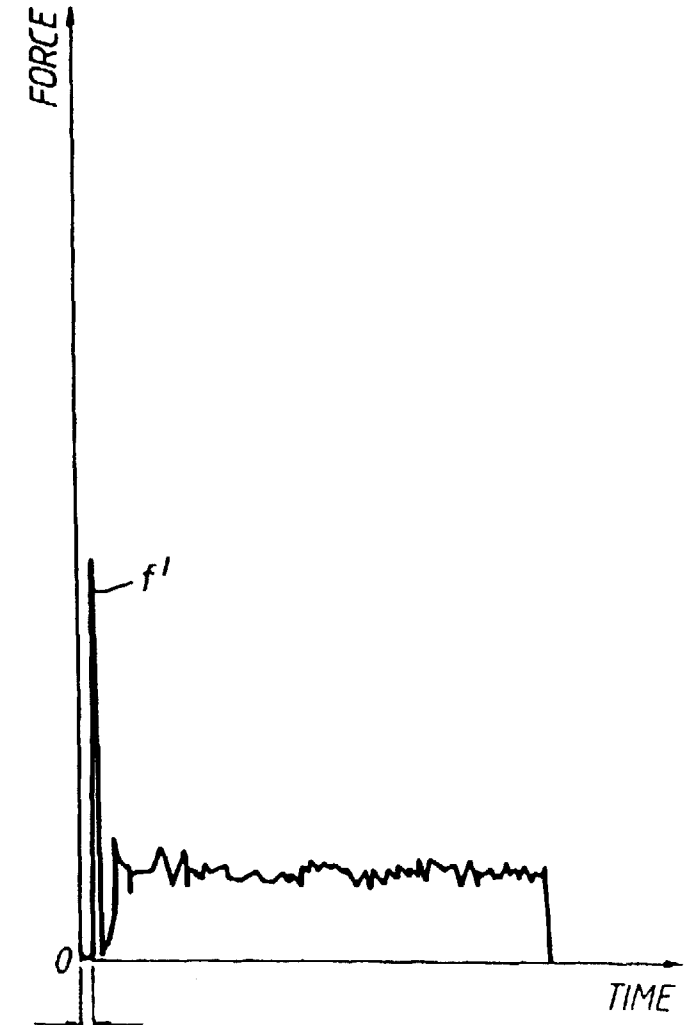
FIGS. 6A and 6B are graphs comparing performances of the drum braking means in apparatus with and without an inertia member.
Figure 6B:
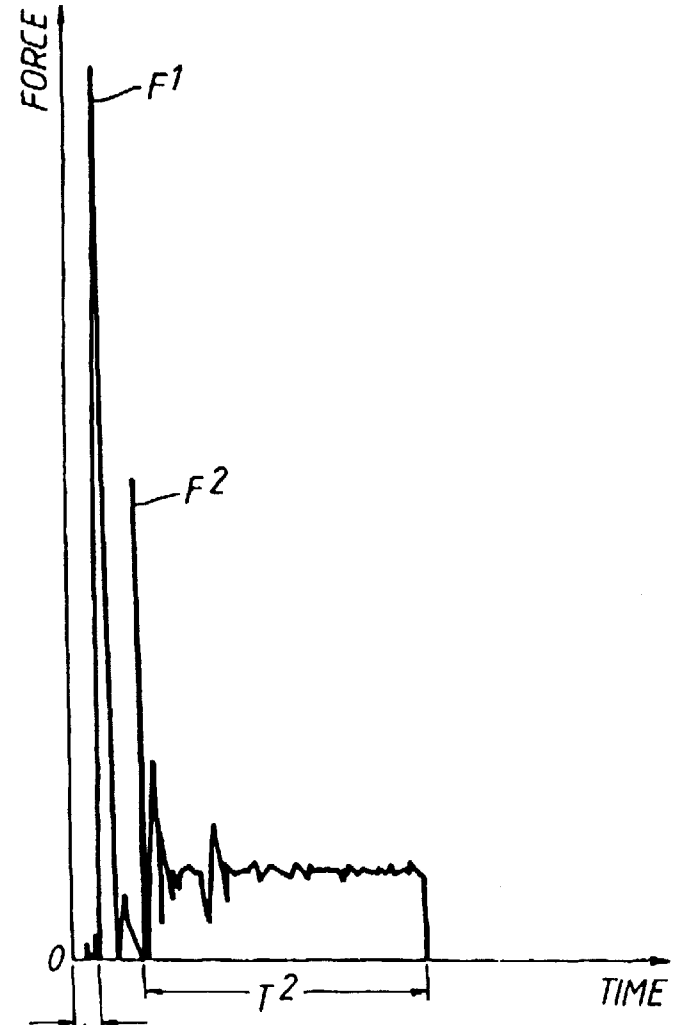

The effect of the inertia member 20 on the braking of the cable drum and on the fall-arrest forces sustained by a falling body is illustrated by the comparative graphs, FIGS. 6A and 6B. The graphs were plotted by a force recorder interposed between the drum 1 of the apparatus and a fixture from which it was suspended. A weight comparable to that of a heavy human body was attached to the cable 3 but was initially supported from below so that it did not exert any force on the apparatus. The recorder was set to register the suspended weight of the apparatus as zero. The weight was then released to simulate the fall of a worker.

A first test was performed with an apparatus as described with reference to FIGS. 1 and 2 except that it did not incorporate an inertia member (member 20). FIG. 6A shows the forces transmitted to the recorder in function of time commencing at the moment of release of the weight. The commencement of the initial rapid increase in the recorded force up to the peak value F' coincides with the start of the operation of the friction brake and took place after time T'. The fact that the subsequent rapid reduction in the recorded force reached zero and was followed by a further surge of force F2 is due to inevitable "bouncing" of the weight following the arrest of the cable drum. Persistance of bouncing, albeit of lower amplitude, accounts for the subsequent fluctuation in the recorded force exerted by the suspended weight over the period t2.

A second identical test was performed using fall-arrest apparatus identical with that used in the first test except that it incorporated the inertia member 20. The forces recorded in function of time are represented by FIG. 6B. Comparing FIG. 6B with FIG. 6A it is apparent that the inertia member had the effect of shortening the time between the release of the weight and the initiation of the operation of the friction brake from T' to t'. In consequence the kinetic energy of the falling weight at the instant the brake was applied was considerably less than in the case of the first test. The maximum recorded force f' was less than half of the maximum force F' recorded in the first test.

The precise effect of the inertia member on the performance of the brake mechanism in apparatus as illustrated depends on the resistance of the pawls 17 to displacement towards their operative positions by centrifugal forces, which in turn depends, inter alia, on the biasing force exerted by the springs 19, and on the inertia of the inertia member 20, which is a function of its mass and the frictional resistance to its rotational movement relative to the cable drum. In the illustrated apparatus, this latter resistance is so small as to be negligible.

While the invention has been illustrated by an embodiment in which the coupling elements (pawls 17) of the clutch are movable towards their operative positions by centrifugal force the involvement of centrifugal force in the operation of the clutch is not an essential feature of the invention. The invention includes apparatus wherein the coupling elements are displaced into their operative positions solely under force exerted in consequence of their abutment against the inertia member 20. For example the clutch can incorporate pivoted coupling elements which are balanced about their pivotal axes.

Furthermore the invention is not restricted to apparatus wherein there is a single inertia member 20. For example, the invention includes in its scope apparatus in which there are two clutch coupling elements and two inertia members, one for cooperating with each of such elements.

Reference will now be made to the embodiment of the invention shown in FIG. 7.

Figure 7:
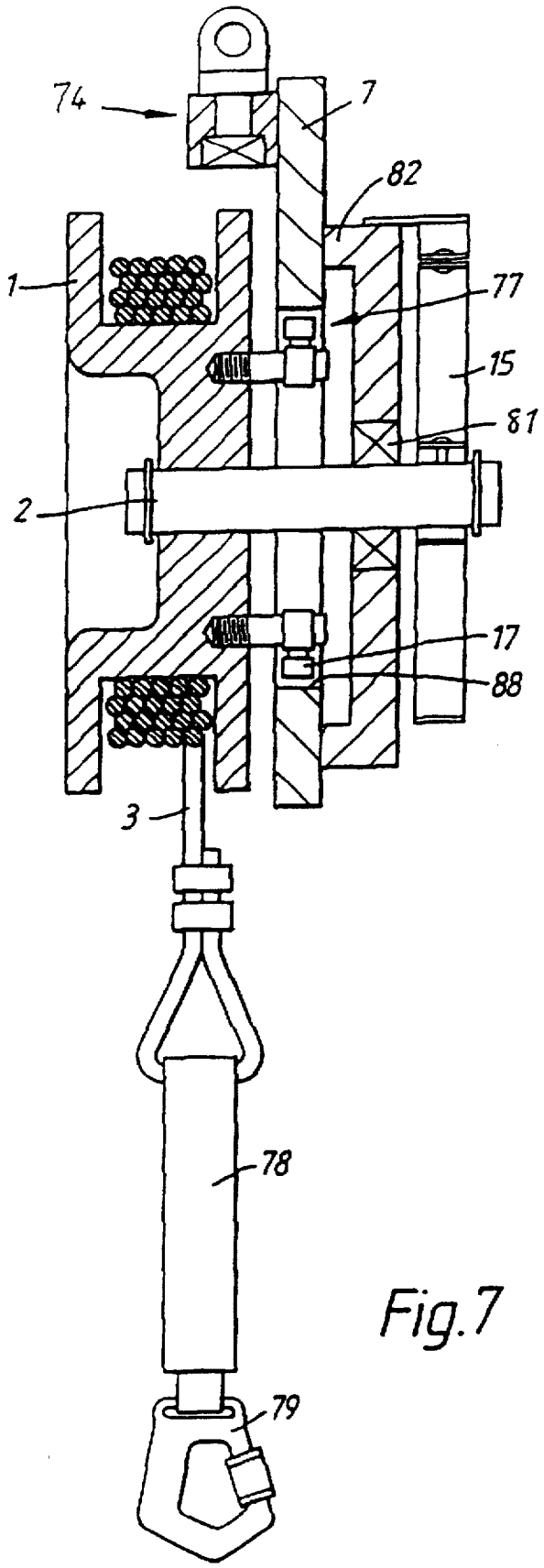
FIG. 7 illustrates an alternative embodiment in which no brake means are present.

Referring to FIG. 7, the fall arrest apparatus here shown comprises a line drum 1 supported by a shaft 2 for rotation relative to a rigid plate member 7 adapted to be secured to a fixed anchorage, for example with an intervening swivel 74. The shaft 2 rotates in a bearing 81 housed in a rigid casing 82 which is fast with the plate 7.

A safety line 3 is wound on the drum 1 and which can be paid out with the drum unwinding against the influence of a rewind coil spring 15. The inner end of the coil spring 15 is attached to the shaft 2 and the outer end of the spring 15 is attached to the casing 82.

An unwind rotational speed sensitive clutch means generally designated 77 is operable between the rigid plate member 7 and the drum 1, and is effective to stop rotation of the drum relative to the rigid plate member when a predetermined speed of drum rotation is reached.

The safety line 3 incorporates at or towards its outboard end, an energy dissipating unit generally designated 78 for cushioning shock loads occasioned by the safety line. The energy dissipating unit 78 is so connected in the safety line 3 that it can only be disconnected by such destructive breaking of the connection as to render the connection non-reusable.

For example the line 3 terminates in a loop secured by binding which can only be undone by destructive severance. Similarly the unit 78 is secured to a metal hook member 79 and the connection therebetween is such that it can only be unmade by destructive cutting or shearing.

The energy dissipating unit 78 is preferably of the tear webbing type which is per se well known. In this a length of webbing is stitched in folds and when shock occurs the stitches rupture to allow the folded webbing to unfold. Such devices can be set to operate at a specified threshold; that is the stitches begin to rupture at a predetermined shock loading such as 3 or 6 KN. The maximum extensibility of such a device can be predetermined. A typical maximum extensibility is 1 metre.

The clutch mechanism 77 is a speed sensitive clutch device incorporating an inertia member as described above with reference to FIGS. 1 to 6. It has pawls 17 which are engageable with teeth formed at the periphery of an aperture 88 formed in the spine plate 7, the movement of the pawls 17 into engagement with the teeth of the aperture 88 being assisted by an inertia member (not shown), the operation being analogous to the operation of the inertia member 20 described with reference to FIGS. 1 and 2.

With appropriate choice of components, design and testing, such a clutch mechanism 77 can be rendered very sensitive and lock up can be ensured when a predetermined speed of drum rotation is exceeded; while on the other hand, at lower speeds, drum rotation at normal payout and rewind speeds is freely permitted. Also, while this embodiment of the invention provides a device wherewith safety line payout can be interrupted abruptly whenever a predetermined payout speed is exceeded and thus predetermination of lock up speed can be set with accuracy, moreover, once lock up occurs, the tear-webbing type of energy dissipating unit used for shock cushioning has the advantage that its maximum extensibility is known. Accordingly a fall arrest mechanism with fully predictable performance is obtained.

Because the fall arrest mechanism now proposed and as shown in FIG. 7, has no braking mechanism, in the event of a fall, reliance is placed exclusively upon the energy dissipating unit 78, to provide cushioning, and accordingly it is vital that the unit 78 is made inseparable from the line 3. In this way it is not possible to make use of the line 3 and drum 1 with its clutch mechanism 77 without the unit 78 being present and in good operative condition. Removal of the unit 78 is only possible by destructive severance of its connections. If the unit 78 is of the webbing type it breaks open when used, giving a clear indication of such use.

Similarly the line 3 will be attached to the line drum 1 by connecting means which require to be broken if the attachment is to be discontinued. Thus the drum 1, the line 3, the device 78 and the terminal hook member are all inseparably connected together and must be replaced all together. There is therefore little likelihood of inadvertent reuse which might involve risk. The intention is that the device now proposed should be used once only, and that after such single use it will require to be entirely replaced.

Although the energy dissipating unit 78 inseparably incorporated in the fall apparatus of the present invention, is preferably of the above described tear webbing type, other types of energy dissipating unit can be employed instead, provided that they are incorporated by means of connections which can only be unmade by destructive severance.

Also as above described the drum 1 is supported by the shaft 2 for rotation relative to a rigid spine plate member 7 by means of a bearing 81 in a casing 82 fast with the plate 7. However, in apparatus according to the invention, instead of the spine plate 7 with its casing 82, there could be substituted a rigid housing. In this case, the drum 1 would be located encased within the housing and the shaft 2 could have its opposite ends supported by bearings fixed to the housing walls.

As a further alternative, the fall arrest apparatus according to the invention could be provided with a manually operable winch mechanism with the aid of which the line drum could be wound or unwound. For example such a winch might be employed to lower a fallen worker to a platform or to the ground.

I claim:

1. Fall-arrest safety apparatus which is attachable to a fixture and incorporates a safety line drum (1) for holding a safety line (3) and permitting it to be drawn from the drum (1) in response to pulling force on the line exerted by a person attached to that line; the apparatus having means which functions automatically initiated by activation of a speed sensitive clutch device to decelerate the drum if its unwinding speed becomes excessive as it does in the event of the worker falling; characterised in that the speed-sensitive clutch device for initiating deceleration of the safety line drum incorporates (a) at least one drive-transmitting coupling element (17) which is connected to the safety line drum (1) so that it bodily rotates with the drum (1) about its axis of rotation and is displaceable from an inactive position (FIG. 1) into a drive-transmitting position (FIG. 2) in which it transmits drive and (b) an inertia member (20) which is freely rotatable about said axis and relative to the drum itself; and in that said inertia member (20) is formed and disposed so that on rapid acceleration of the drum (1) in consequence of a fall it exerts pressure, due to its inertia, against said coupling element (17) thereby to cause or assist movement thereof into its drive-transmitting position.

2. Apparatus according to claim 1, wherein said at least one coupling element (17) is arranged so that it is movable into operative position (FIG. 2) under the action of centrifugal forces and the movement of said element (17) into operative position takes place under the combined action of centrifugal force and pressure exerted by the inertia member (20).

3. Apparatus according to claim 2, wherein the inertia of the inertia member (20) is such that on rapid acceleration of the drum (1) such as occurs in consequence of a fall of a worker attached to the safety line, the coupling elements (17) of the clutch move into operative position sooner than if reliance were placed on movement of such elements (17) solely under centrifugal force.

4. Apparatus according to claim 1, wherein there is more than one said coupling element (17) and wherein each said coupling element is in contact or very close to a common inertia member (20) which always moves the plural elements (17) simultaneously and to the same extent.

5. Apparatus according to claim 1, and in which the drum (1) is carried on a shaft (2) for rotation relative to a fixed plate (7) adapted to be secured to an anchorage at an elevated location on a building structure or the like, and in which the drive transmitting coupling element (17) is in the form of a pawl which is mounted on the drum (1) for pivotal movement relative to the drum, said pawl moving within an aperture (88) in said plate (7) and said pawl (17) being pivotal into engagement with a tooth formed at the periphery of said aperture (88) in said plate (7) in order to stop rotation of said drum (1) relative to the plate (7).

6. Apparatus according to claim 5, and wherein the safety line (3) wound on the drum (1) incorporates at or towards its outboard end, an energy dissipating unit (78) for cushioning shock loads occasioned in the safety line (3), said energy dissipating unit (78) being so connected in the safety line (1) that it can only be disconnected by such destructive breaking of the connection as to render the connection non-reusable.

7. Apparatus according to claim 1, and in which the drum (1) is carried on a shaft (2) for rotation relative to a fixed plate (7) adapted to be secured to an anchorage at an elevated location on a building structure or the like, and in which the drive transmitting coupling element (17) is in the form of a pawl which is mounted on the drum (1) for pivotal movement relative to the drum, said pawl (17) being pivotal into engagement with a rotatable braking component (6, 8), there being a non-rotatable braking component (11) fast with said plate member (7) and friction brake means (9, 10) interposed between said rotatable and said non-rotatable breaking components effective to resist relative rotation of said respective components, all whereby rotation of said drum (1) relative to said plate (7) is retarded when said pawl (17) pivots into engagement with the rotatable break component (6, 8).

* * * * *